US007989759B2

(12) United States Patent
Holle

(10) Patent No.: US 7,989,759 B2
(45) Date of Patent: Aug. 2, 2011

(54) CLEANED DAUGHTER ION SPECTRA FROM MALDI IONIZATION

(75) Inventor: Armin Holle, Achim (DE)

(73) Assignee: Bruker Daltonik GmbH, Bremen (DE)

( * ) Notice: Subject to any disclaimer, the term of this patent is extended or adjusted under 35 U.S.C. 154(b) by 275 days.

(21) Appl. No.: 12/237,167

(22) Filed: Sep. 24, 2008

(65) Prior Publication Data

US 2009/0095903 A1 Apr. 16, 2009

(30) Foreign Application Priority Data

Oct. 10, 2007 (DE) ..... 10 2007 048 618

(51) Int. Cl.
*H01J 49/40* (2006.01)

(52) U.S. Cl. ..... 250/287; 250/282

(58) Field of Classification Search ..... 250/287
See application file for complete search history.

(56) References Cited

U.S. PATENT DOCUMENTS 5,202,563 A 4/1993 Cotter et al.
6,013,913 A * 1/2000 Hanson ..... 250/287
6,300,627 B1 10/2001 Koster et al.
6,717,131 B2 4/2004 Holle et al.
7,326,925 B2 * 2/2008 Verentchikov et al. ..... 250/287
7,385,187 B2 * 6/2008 Verentchikov et al. ..... 250/287
2007/0029473 A1 2/2007 Verentchikov
2008/0272291 A1 11/2008 Vestal

FOREIGN PATENT DOCUMENTS

GB 2 390 935 A 1/2004
WO WO 95/33279 A1 12/1995
WO WO 97/48120 A1 12/1997
WO WO 2008/047891 A2 4/2008

* cited by examiner

*Primary Examiner* — Jack I Berman
(74) *Attorney, Agent, or Firm* — Law Offices of Paul E. Kudirka

(57) ABSTRACT

In a mass spectrometer having an ion source in which analyte substances are ionized by matrix assisted laser desorption and form an ion beam that travels to a parent ion selector for selecting ions to form daughter ions, the ion beam is reflected in at least one reflector prior to the parent ion selector so that only ions that have both the mass of the parent ions and their kinetic energy are allowed to pass to the parent ion selector. By taking this measure, the mass resolution in the daughter ion spectra is also increased; the improved mass resolution and improved signal-to-noise ratio produce higher sensitivity, even though fewer ions are admitted for analysis in the daughter ion spectrum.

12 Claims, 3 Drawing Sheets

CLEANED DAUGHTER ION SPECTRA FROM MALDI IONIZATION

BACKGROUND

This invention relates to the generation of daughter ion spectra from analyte substances that are ionized by matrix assisted laser desorption. For the purposes of the ionization of analyte ions by matrix assisted laser desorption, the samples, consisting mainly of matrix substance with a small number of embedded analyte molecules, are exposed to short pulses of light from a UV laser. Each pulse of laser light generates a plasma cloud. When the pulses of laser light have only moderate power, from the analyte substances practically only molecular ions are created, no fragment ions; therefore several types of analyte substance can be present and recognized in the sample simultaneously—in other words, mixture analyses can be carried out. Predominantly, however, complex ions of decomposed and modified matrix substances are also generated. The creation of the analyte and matrix ions in the laser-generated plasma is very intricate, and not every aspect is yet understood. Although the matrix substances have molecular weights in the range of between only 150 and 300 Daltons, the plasma contains many complex ions composed primarily of fragments of matrix molecules of such varied masses that, in the range up to about 1000 Daltons, almost every mass number in the mass spectrum is occupied by multiple ions of different compositions.

The method of ionization by matrix assisted laser desorption is primarily used to investigate large biomolecules, particularly large biopolymers such as proteins or peptides obtained from proteins by enzymatic digestion, which yield mass spectra that can be evaluated effectively above 1000 Daltons, so that the background noise does not prevent the evaluation. It is also possible to investigate conjugates of peptides with sugars (glycopeptides) or fats (lipopeptides).

By recording the mass spectra of daughter ions obtained through deliberate fragmentations of the analyte ions, the protein sequences, and also the structures of the conjugates, can be analyzed. Two different kinds of fragmentation can be carried out in special MALDI time-of-flight mass spectrometers in order to generate daughter ions and, particularly in the case of proteins and peptides, they lead to different fragmentation patterns. The two types of fragmentation are referred to as ISD ("in-source decay") and PSD ("post-source decomposition").

To record daughter ion spectra created by PSD, the intensity of the laser light is increased. As a result, a large number of unstable analyte ions are created which, after their acceleration in the mass spectrometer, decompose with characteristic half-lives, so forming daughter ions (also known as fragment ions). The unstable ions which decompose in the flight path of the mass spectrometer are referred to as "metastable" ions. Increasing the intensity of the laser light, however, increases not only the number of metastable analyte ions but also the number and size of the matrix-containing complex ions, which now cover masses of up to 3000 Daltons and above. Recording the PSD daughter ion spectra is at present done in time-of-flight mass spectrometers specially designed for this purpose, such as are described in detail in patent DE 198 56 014 C2 (C. Köster et al., corresponding to GB 2 344 454 B and U.S. Pat. No. 6,300,627 B1).

FIG. 1 schematically illustrates a MALDI state-of-the-art time-of-flight mass spectrometer of this type for recording daughter ion spectra. A UV pulsed laser (3) sends a pulse of laser light through a focusing lens (4) and a deflecting mirror (5) onto the sample (6), which is located on a sample support (1) in a solid state obtained by drying a droplet of sample solution. A small amount of the sample material abruptly evaporates, creating a plasma cloud. Accelerating potentials at the acceleration diaphragms (7) and (8) form the ions in the plasma cloud into an ion beam (9); moderate accelerating voltages give the ions that will be used for recording the daughter ion spectra a relatively low energy of only, for instance, 6 keV. Switching on the accelerating voltage with a delay relative to the flash of laser light provides time-focusing of the ions at the location of the parent ion selector (10), improving selection. This parent ion selector is a bipolar switchable grid which only allows ions through during an adjustable switching time window, so making them available for further analytical investigation. The parent ion selector is thus used to select the parent ions whose daughter ions are to be measured. If metastable parent ions have already decomposed between the acceleration diaphragm (8) and the parent ion selector (10), the daughter ions created here can also pass through the parent ion selector, as they have the same velocity as the undecomposed parent ions, and therefore arrive at the parent ion selector at the same time as the latter arrive.

The undecomposed parent ions and the daughter ions that have been created through the decomposition of parent ions, now fly on to a post-acceleration unit (12), where they are given an additional acceleration by about 20 kilovolts. Prior to the post-acceleration, the daughter ions only possess a fraction of the energy of the parent ions, corresponding to their mass fraction relative to the parent ion. The post-acceleration now gives the daughter ions an energy of between 20 and 26 keV, which is particularly favorable for an analysis of their energy—and therefore of their mass—in the reflector (14). The energy analysis, in turn, is carried out by analyzing the time-of-flight at the detector (17), since the lighter ions, even if lower in energy, are faster and also reach the detector more quickly along the shorter beam (15) than the more energetic, but slower, ions traveling along the beam (16) that enters more deeply into the reflector (14).

In order that those daughter ions created by decomposition of the post-accelerated parent ions that have not yet decomposed cannot reach the reflector (14), a further ion selector (13) is included in the ion path between the post-acceleration unit (12) and the reflector (14) to suppress the parent ions and their equally fast daughter ions. This parent ion suppressor is not only necessary to suppress the daughter ions created after the post-acceleration, but also to suppress the continuous background that would be generated by the daughter ions from parent ions that decompose further at an undetermined potential in the reflector.

In this modern PSD method for recording daughter ion spectra, it is therefore necessary to select the parent ions whose daughter ion spectra are to be recorded. However, not only the parent ions are selected by means of the switchable grid in the parent ion selector (10) during the switched time window, but also a large number of the extraordinarily frequent matrix-containing complex ions, or the fragment ions that have formed from them, provided only that the complex ions have the correct mass and therefore arrive at the parent ion selector within the correct time window. These fragment ions, formed from the complex ions, result in a background noise signal which, by raising the noise, lowers the sensitivity.

If the complex ions contain relatively large, stable molecule fragments, such as analyte ions from the analyte mixture that are not to be selected at all, ghost signals can occur. It has been observed, for example, that the molecular ions of other types of analyte ion from the sample that were not selected as parent ions appeared in the daughter ion spectra. These molecular ions could only have attained a mass equal to that of the selected parent ions by complexing with matrix fragments. In this way they can pass through the parent ion selector, and are then measured in the daughter ion spectrum, if decomposed back into analyte ions and the associated complex of matrix fragments. It must here be emphasized yet again that these ghost signals can also be measured if the complex ions decompose soon after full acceleration, but at a point that is still distant from the parent ion selector.

It appears possible that a high proportion of the analyte ions are created in a way that temporarily includes such a complex state. It is entirely possible that a matrix complex ion attaches to a neutral analyte molecule, transfers a proton to the analyte molecule, and splits off again after a rearrangement and stabilization time. It is also possible to transfer additional energy to the analyte molecule, with the result that it then becomes metastable and can decompose further at a later stage. The lifetime of these complexes is not known. If such a complex ion consisting of an unwanted analyte ion with attached matrix molecule fragments happens to have exactly the mass of the parent ions that are to be selected, and if it survives the acceleration in the ion source, it will be included in the selection made by the parent ion selector, and can lead to ghost signals when it decomposes. It is most probable that the associated decomposition will occur a long way upstream of the parent ion selector.

If, on the other hand, the complex ions already decompose in the acceleration region, this will yield ions of lower, undefined velocity. These ions constitute a high proportion of the undefined, smeared background of every MALDI mass spectrum. A proportion of these ions reaches the parent ion selector at exactly the time when it is open in order to select the parent ions. Whether or not these ions then decompose further, they create a more or less continuous background in the daughter ion spectra, smeared across all the masses in the mass spectrum.

If the complex ions that contain an analyte molecule decompose prior to the acceleration, that is to say in the delay phase before the acceleration is switched on, into an analyte molecule and the attached remainder, these analyte ions can contribute to the analysis quite normally. Their mass and charge is identical to the ions originally created in the plasma. Once again, a large number of metastable analyte ions can result.

Metastable ions of the same type but different genesis do not have a consistent half-life. Rather, their half-life depends on the internal energy that they have absorbed in the plasma or in complexing processes. It is not known whether the type of decomposition, that is the fragmentation pattern of the bonds between the individual molecule parts, also depends on the quantity of internal energy. All that is known is that the spontaneous fragmentation of protein ions in a time range of less than $10^{-8}$ seconds (ISD) demonstrates a remarkably different fragmentation pattern from the fragmentation of the metastable ions (PSD) decaying in a time range greater than $10^{-5}$ seconds. The spontaneous fragmentation (ISD) can be classified as an "electron-induced" type of fragmentation, whereas the slow fragmentation (PSD) is regarded as "ergodic" fragmentation, which, in principle, requires a balanced internal distribution of the energy across the individual vibration states. It is not known whether there is an intermediate state with mixed fragmentation patterns.

The degree to which the decomposition half-life of metastable ions depends on their mass and the internal structure is also unknown. There are, however, some indications that metastable complex ions have very short half-lives and decompose very quickly, the great majority doing so before reaching the parent ion selector.

As was already explained above, there is a second type of fragmentation (ISD) that can be exploited for recording daughter ion spectra. It does not, however, play any role in this invention. It is based on the fact that the ions also fragment spontaneously in the laser plasma. If a sample that contains only one analyte substance at a suitable concentration is exposed to a pulse of laser light of high intensity, fragment ions of the analyte substance form within a period of less than $10^{-8}$ seconds. Due to the delay prior to the start of acceleration, these fragment ions are only accelerated after they have been formed, and can therefore be measured in a mass spectrum recorded in the normal way. This type of daughter ion formation is called ISD ("in-source decomposition").

The term "mass" here always refers to the "mass-to-charge ratio" m/z, which alone is relevant for mass spectrometry, and not simply the "physical mass", m. The dimensionless number z represents the number of elementary charges on the ion, that is the number of excess electrons or protons on the ion that have an external effect as an ion charge. Without exception, all mass spectrometers can only measure the mass-to-charge ratio m/z, not the physical mass m itself. The mass-to-charge ratio is the mass fraction per elementary charge on the ion. Correspondingly, "light" or "heavy" ions always refers to ions with a low or high mass-to-charge ratio m/z. The term "mass spectrum" again always refers to the mass-to-charge ratios m/z.

SUMMARY

The invention consists in reflecting the ion beam at least once in an electrical reflector prior to the parent ion selector in order to mask out all those ions that do not have the correct kinetic energy, so that only parent ions with correct mass and correct energy are allowed to pass the parent ion selector. The original direction of the beam is to be retained, if necessary with the aid of additional deflection capacitors. This filters out all those ions that decompose quickly, including, to a large extent, all the fragments of the complex ions. In addition, all those ions that have already decomposed in the acceleration region and have not received the full acceleration are also filtered out. The mass spectrum of the daughter ion therefore exhibits a greatly weaker undefined background noise, and is practically free from ghost signals.

If the reflection is correctly dimensioned, the time-focusing of ions of the same mass, in particular, is further improved, in comparison with the basic focusing by the delayed start of the acceleration. The parent ions in the parent ion selector are thus cut off more sharply than before.

Surprisingly this measure causes the mass resolution in the daughter ion spectrum to also be improved. It may be supposed that those ions that decompose later possess, on average, less internal energy, and are therefore subject to a smaller recoil (kinetic energy release) when they decompose. Due to this improved mass resolution and the improved signal-to-noise ratio, a greater sensitivity is achieved even though considerably fewer ions pass through to analysis in the daughter ion spectrum than do without this reflection. The improved mass resolution also results, very favorably, in a more accurate determination of the mass of the daughter ions.

A double reflection can be achieved by means of two electrical ion reflectors positioned at an angle to the flight-path of the ions, which, as can be seen in FIGS. 2 and 4, results in a lateral displacement of the ion beam. Deflecting units prior to and behind these two reflectors can, as shown in FIG. 5, can be used to prevent the ion beam from experiencing a lateral displacement, thus enabling a unit of this sort to be used in existing types of time-of-flight mass spectrometer. It is also possible, as shown in FIGS. 3 and 6, to use two reflectors, through which ions can pass, in series. In this case, the reflecting electric fields must be switched on and off rapidly and with accurate timing. Using two deflection capacitors and one reflector it is again possible, as can be seen in FIG. 7, to achieve an improvement in the daughter ion spectra in accordance with the invention without displacing the beam; here, however, a cylindrical lens is additionally required in order to overcome the beam divergence. The units which do not cause any displacement in the ion beam can also be removed from the ion path mechanically when it is desired to use the time-of-flight mass spectrometer to record normal mass spectra for the molecular ions.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

Figure 1:
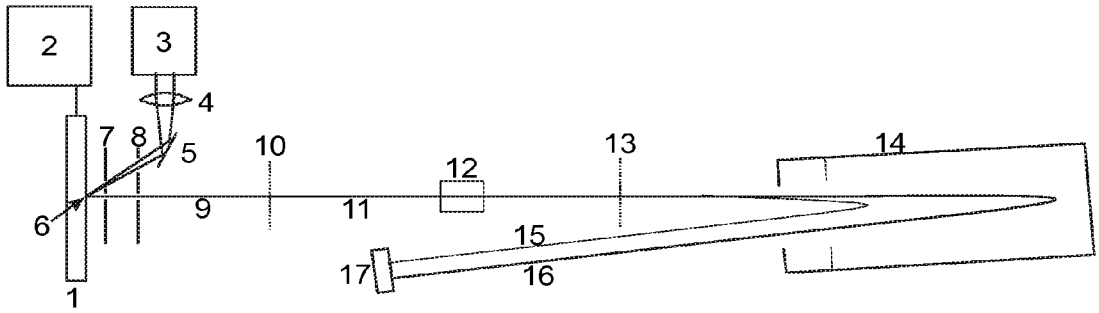
FIG. 1 (Prior Art)
FIG. 1 shows schematically a MALDI time-of-flight mass spectrometer for recording daughter ion spectra according to the prior art. On a sample support plate (1) there are dried sample portions, which can be moved mechanically, one after another, by the positioning unit (2) into the focus of the UV laser (3). A pulsed UV laser (3) sends a pulse of laser light through a focusing lens (4) and a deflecting mirror (5) onto a sample (6). The ions that are formed in the desorption plasma are shaped into an ion beam (9) by potentials at the acceleration diaphragms (7) and (8). The parent ion selector (10) only allows the selected analyte ions, known as "parent ions", to pass by switching on a non-deflecting time-window, along with the decomposition products of these parent ions that are flying at the same speed. The parent ions, and the daughter ions created from the decomposition of the parent ions, are given a further acceleration of about 20 kilovolts in a post-acceleration unit (12), and their masses are analyzed by reflection in an ion reflector (14). A further ion selector (13) suppresses the parent ions and the daughter ions that have formed after the post-acceleration, so that their further decomposition products, particularly those formed in the reflector, do not create a continuous background signal.

FIG. 1 first shows schematically a MALDI time-of-flight mass spectrometer for recording daughter ion spectra according to the prior art. On a sample support plate (1) there are dried sample portions, which can be transferred, one after another, by the positioning unit (2) into the focus of the UV laser (3). The samples consist of fine crystals of matrix material, into which analyte molecules have been embedded by the drying process from solution droplets. The ratio of analyte molecules to matrix molecules should be 1:10000 at most. A pulsed UV laser (3) sends a pulse of laser light with a duration of approximately 0.1 to 10 nanoseconds through a focusing lens (4) and a deflecting mirror (5) onto a sample (6). Some of the sample material abruptly evaporates, creating a plasma cloud. Accelerating potentials at the acceleration diaphragms (7) and (8) shape the ions generated in the plasma cloud into an ion beam (9). The ions that will be used for recording the daughter ion spectra are accelerated by relatively low voltages, for instance, 6 keV. Switching on the acceleration after a delay following the flash of laser light creates time-focusing of the ions, the focal length being adjustable. The time-focusing occurs at approximately the same point for ions of all masses, but the time of flight up to this point depends on the mass of the ions. The focusing length is adjusted in such a way that the ions in the plasma cloud experience their time focusing at the site of the parent ion selector (10). This parent ion selector is a bipolar switchable grid that only allows ions to pass straight through during an adjustable switching time window, so making them available for further analytical investigation. The parent ion selector thus chooses the parent ions whose daughter ions are to be measured. If metastable parent ions have already decomposed between the acceleration diaphragm (8) and the parent ion selector (10), the daughter ions created here can also pass through the parent ion selector because they have the same velocity as the undecomposed parent ions, and therefore arrive at the parent ion selector at the same time as the latter arrive.

The undecomposed parent ions and the daughter ions created by the decomposition of parent ions now fly in ion beam 11 on to a post-acceleration unit (12), where they are given an additional acceleration by about 20 kilovolts. Prior to the post-acceleration, the daughter ions only possess that fraction of the 6 keV of energy that corresponds to the ratio of their fractional mass to the mass of the parent ion. The post-acceleration now gives the daughter ions an energy of between 20 and 26 keV. The light ions are the fastest, although they have somewhat less kinetic energy. The mass analysis can, therefore, again be carried out as a time-of-flight analysis at the detector (17).

To prevent those daughter ions that are created by the decomposition of the post-accelerated parent ions from reaching the reflector (14), a further ion selector (13) is installed in the ion path between the post-acceleration unit (12) and the reflector (14) in order to suppress the parent ions and their equally fast daughter ions. This parent ion suppressor is not only necessary to suppress the daughter ions created after the post-acceleration, but also to suppress a continuous background noise that would be generated by the ions that decompose in the reflector.

This mass spectrometer according to the prior art, however, accepts all the ions that arrive at the parent ion selector within the correct time window for measurement in the daughter ion spectrum. This is a very large number of ions, including many unwanted ions, such as all the decomposed and undecomposed complex ions of the same mass as the parent ions, many ions that decompose in the acceleration region and slip through the parent ion selector, and many ions that are generated in the acceleration region having their lower mass compensated by a lower kinetic energy. These unwanted ions impose a strong background of undefined ions on the daughter ion spectrum, and so reduce the sensitivity of measurement.

The fundamental idea of the invention, therefore, is to mask out these ions that do not belong with the daughter ions as fully as possible, so that they cannot reach the parent ion selector, but also to provide good time-focusing of ions of the same mass. This can be done, according to the invention, by filtering the ions in at least one reflector according to their energy, whilst at the same time providing energy-focusing for ions of the same mass. Only ions with the selected correct mass and the associated correct energy are then able to reach the parent ion selector. The reflector is favorably implemented as a double reflector, but arrangements with only a single reflector or with more than two reflectors are also possible. There are several favorable arrangements for the double reflector.

Figure 2:
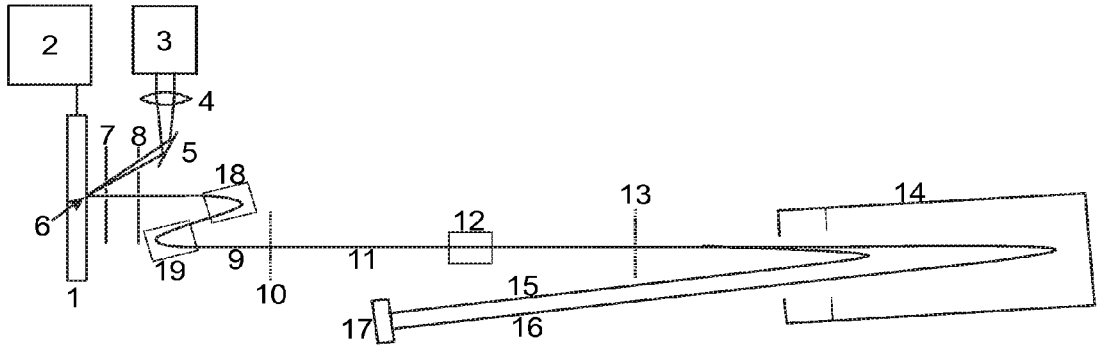
FIG. 2 illustrates an embodiment of the invention in which the two reflectors (18) and (19) deflect the ion beam between the acceleration diaphragm (8) and the parent ion selector (10) in such a way that essentially only those parent ions that have not yet decomposed can reach the parent ion selector. In this arrangement the ion beam (11) is laterally displaced in comparison with the ion beam after acceleration.
Figure 4:
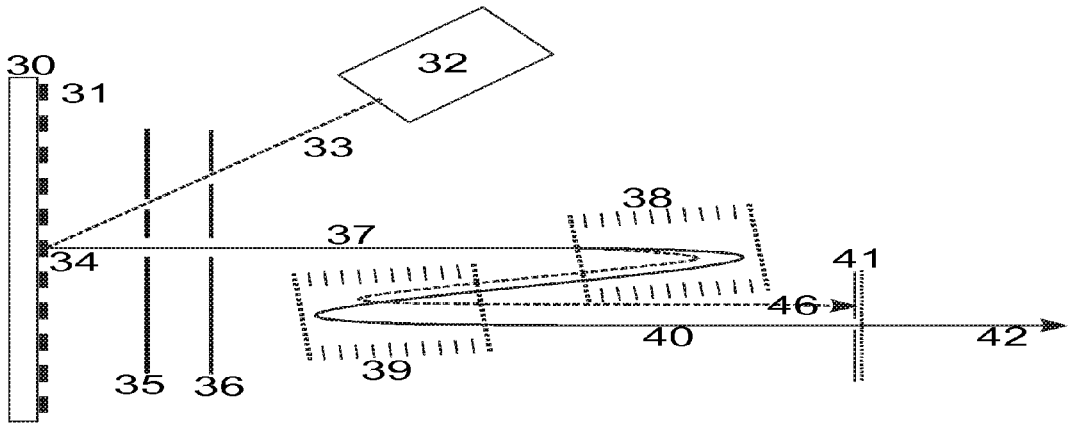
FIG. 4 illustrates the flight path of the ions from FIG. 2 through the reflectors (38) and (39) in more detail; the UV laser (32) with its beam of laser light (33) is now shown in a simplified form. The ion beam (40) is displaced with respect to the ion beam (37).

A first arrangement with a double reflector is illustrated in FIGS. 2 and 4; the explanation here will concentrate particularly on the magnified FIG. 4 of the region around the double reflector. Two angled ion reflectors (38) and (39) are able to generate a homogeneous electrical reflection field in their interior by means of potentials applied to widely opened annular diaphragms. In this reflection field, the entering ions are first braked until a full stop and then accelerated back out again. The entrance to each of the two reflectors is closed by a very permeable grid, in order that as few ions as possible are filtered out through impacts on the grid wires, but the field inside the reflector is nevertheless homogenized. The ion beam (37) created by acceleration at the diaphragms (35) and (36) is reflected back and forth in the two reflectors (38) and (39). Parent ions leave the double reflection as an ion beam (40) in the same direction as they entered the reflectors. The ion beam (40) is, however, laterally displaced with respect to the ion beam (37), so that these double reflectors require a specially constructed time-of-flight mass spectrometer that allows for this displacement.

Any ions that do not possess the full energy of the acceleration pass through the two reflectors on other paths, of which one path (46) is drawn dotted in FIG. 4. These ions impinge on a diaphragm that belongs to the parent ion selector (41). These rejected ions include practically all the complex ions, as these decompose with a very short half-life. They also include all those ions that decompose in the acceleration region between the sample support plate (30) and the acceleration diaphragm (36), and which therefore do not achieve the full acceleration energy. They also include all the daughter ions that have formed on the path (37) or in the reflectors. This loss of daughter ions is, however, compensated for by a significantly cleaner daughter ion spectrum, whose improved ratio of daughter ion signals to background noise offers greater measurement sensitivity. The interpretation of the daughter ion spectrum is made a great deal simpler through the absence of ghost signals. Only those daughter ions now appear in the mass spectrum that form on the ion paths (40, 9) and (42, 11) leading up to the post-acceleration unit (12).

The ions of lower energy that are to be rejected can also be masked out by other diaphragms included in the ion path. The entrance grids, for instance, can be replaced by solid plates, each having just one inlet opening and one outlet opening for the ions of the correct energy.

Figure 5:
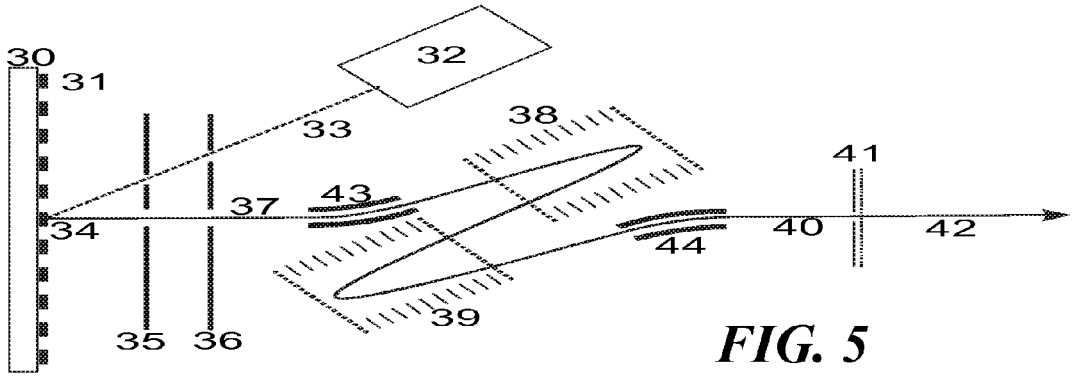
FIG. 5 illustrates an arrangement with two reflectors (38) and (39), in which the addition of deflection capacitors (43) and (44) prevents the ion beam (40) from being displaced with respect to the ion beam (37). This double reflection unit can be installed in existing types of time-of-flight mass spectrometer.

The displacement of the ion beam is somewhat disadvantageous if such double reflection is to be integrated into an existing MALDI time-of-flight mass spectrometer without making relatively large changes to the design. For this reason, FIG. 5 illustrates a second embodiment that does not exhibit this beam displacement. Here, two deflection capacitors (43) and (44), implemented in a curved form, before and after the two reflectors (38) and (39) correct the ion path in such a way that the beam is no longer displaced. This arrangement has the further advantage that the additional deflection capacitors (43) and (44) achieve an even sharper energy filtering. Each of the deflection capacitors (43) and (44) itself acts as an energy filter.

Many modifications of this embodiment are possible. Curved deflection capacitors (43) and (44) as shown here may be used, or the deflection capacitors may be straight. The deflection capacitors (43) and (44) may also have a tighter curve, as a result of which the reflectors (38) and (39) are positioned at a greater angle. The deflection capacitors do not have to be located symmetrically; instead, one deflection capacitor can deflect the ion beam more than the other. In the limiting case it is also possible to use only one deflection capacitor before or after the two reflectors, and to position the two reflectors in such a way that the ion beam is not displaced. Positioning the deflection capacitors symmetrically has the advantage that the beam divergence generated in the first deflection capacitor for ions of the same mass but different initial energies can be cancelled again in the second deflection capacitor.

This second embodiment, which does not displace the beam, is particularly suitable for installing in MALDI time-of-flight mass spectrometers of existing design. It is only operated with DC voltages that do not have to be switched. The ion beam feeds all the undecomposed molecular ions of the mass concerned successively to the parent ion selector. Only the parent ion selector (41) undergoes time-switching, apart from the post-acceleration unit (12) and the unit for parent ion suppression (13), which may also have to be switched, depending on the mode of operation.

Figure 3:
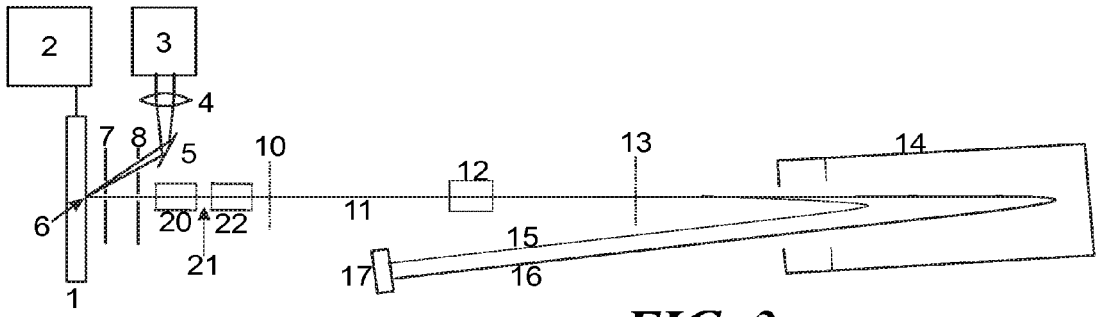
FIG. 3 illustrates an embodiment in which two reflectors with grids at both ends are used for the purpose of the invention. The electric fields in the two reflectors (20) and (22) are initially switched off until the selected parent ions have reached the area (21) between the two reflectors. The electric fields are then switched on; the ions are then reflected in reflector (22) and are returned into reflector (20). Here, too, they are reflected and fly again in the direction of the parent ion selector (10). When they now pass again through the region (21), the electrical reflection fields are switched off again, and the ions can reach the parent ion selector (10).
Figure 6:
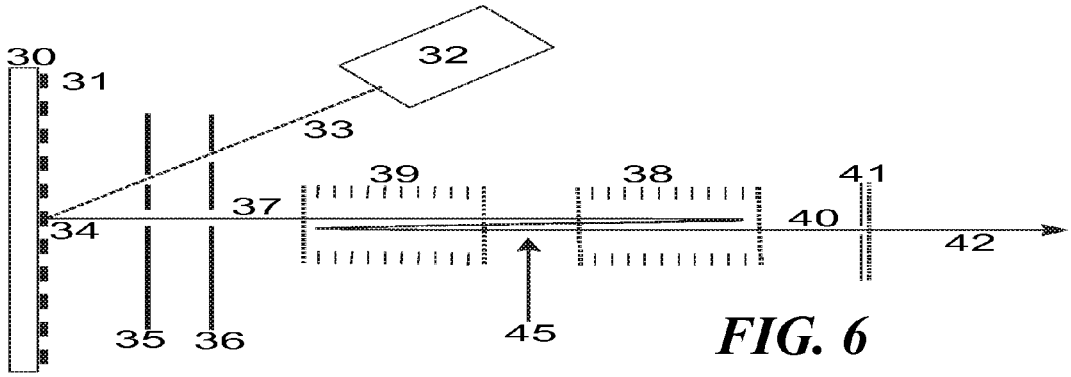
FIG. 6 illustrates the ion path in the two switchable reflectors (39) and (38), corresponding to the reflectors (20) and (22) in FIG. 3, in more detail. The reversal of the direction of the ions in the two reflectors is shown schematically, although the ions fly back along precisely the same path. The electric fields are switched on and off respectively when the parent ions are at the central region (45) traveling towards the parent ion selector (41).

A third embodiment uses two anti-parallel reflectors in series, as is shown in FIGS. 3 and 6. The two reflectors (38) and (39) are here closed at both ends with highly transparent grids, so that the ions can pass through them almost undisturbed when no electric fields are switched on inside them. If these reflectors are used as energy filters, they must be switched in accordance with a programmed rhythm. The slight displacement of the ion beam indicated in FIG. 6 is only shown for better understanding of the flight path of the ions as they move back and forth. In practical embodiments, the ions are reflected back precisely along their former flight path.

One favorable mode of operation is first of all to leave the reflector (38) switched on after the pulse of laser light, so that all the ions are reflected in the direction of the ion source and cannot reach the parent ion selector at all. If the selected parent ions then, after the first reflection, reach the central region (45) between the two reflectors, the electric field in the reflector (39) is switched on so that the parent ions are now also reflected in the reflector (39). When the parent ions now, following the second reflection, again reach the central region (45) between the two reflectors, the electric field in reflector (38) is switched off so that now the parent ions can reach the parent ion selector (41). Operation in this way filters out all those ions with lower energy. Only the undecomposed parent ions and those daughter ions that are created from the central region (45) through to the parent ion selector (41) are now allowed through. All other ions are filtered out. This unit consisting of two anti-parallel reflectors in series is also easy to install in existing MALDI time-of-flight mass spectrometers.

There are several other designs and modes of operation for this embodiment with two reflectors in series. It is, for instance, possible only to switch on the two reflectors when the parent ions pass through the central region (45) for the first time, and to switch both of them off again when they pass through the central region (45) the third time. The two outer grids on the reflectors can also be replaced by plates with central holes. If small pieces of pipe are attached to the central openings, the distorting effect of the homogenous field in the interior is even less. In the limiting case the two reflectors can be moved right up against one another, with now only a single grid between the two reflection fields. It is even possible to omit this grid too, but in this case the two homogeneous electrical reflection fields are replaced by an approximately parabolic saddle-shaped potential well.

Figure 7:
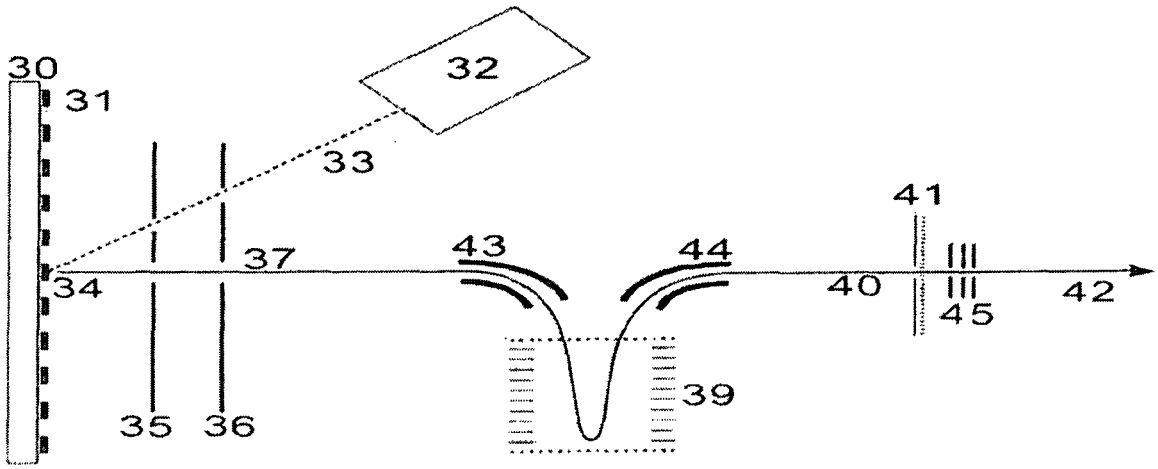
FIG. 7 illustrates an arrangement consisting of two deflection capacitors (43) and (44) and one reflector (39), which also yields good time-focusing of ions of the same mass. Here, however, the divergent ion beam must again be focused into a fine beam by a cylindrical lens (45).

A fourth embodiment has only one reflector (39) and two deflection capacitors (43) and (44), as shown in FIG. 7. It can also be dimensioned in such a way that good time-focusing of all ions of the same mass, independently of their initial energy, is achieved at the parent ion selector (41). However, the fact that the ion beam (37, 40) passes through the two deflection capacitors (43) and (44) in the same deflection direction means that ions of different initial energies form a divergent ion beam after they have passed through. The angle of emergence depends on the initial energy spread. This divergent beam can, however, be focused back to a fine beam by a cylindrical lens (45) positioned either before or after the parent ion selector.

All devices of this type, which do not generate a displacement of the ion beam, can also be moved out of the ion path in order to record normal molecular mass spectra. No loss of ions is then caused by passing through the grids. The units (12) for post-acceleration of the ions and (13) for suppression of the residual parent ions can also be moved out of the ion path. All of these units are only required for recording daughter ion spectra, and are only moved into the ion path for this purpose.

With some of the embodiments, e.g. that shown in FIG. 4, it is possible to improve signal to noise for the original mass spectra of the ion mixture because only the ions with correct masses and correspondent correct energies are recorded.

For recording daughter ion spectra, in principle, a single ion species can serve as the parent ions. All organic materials, however, contain a mixture of the isotopes of their elements; the mass spectrum therefore contains what are known as isotope groups, occupying several successive mass signals of the mass spectrum. If the parent ion selector only filters out those ions that only consist of the main isotopes of their elements, that is $^{1}H$, $^{12}C$, $^{14}N$, $^{16}O$ or $^{32}S$, then only one signal for each type of daughter ion will appear in the daughter ion spectrum. It has, however, become common to select the entire isotope group in the parent ion selector so that the various isotope groups are also seen in the daughter ion spectra. The visibility of the isotope groups in the daughter ion spectra increases confidence that they have been correctly identified.

The selection of the entire isotope group by the parent ion selector does increase the proportion of unwanted ions that are also admitted. It is particularly in this case that a device according to this invention brings a sharp improvement to the analytic process, both from the point of view of easier interpretation of the daughter ion spectra through the removal of the ghost signals, and also in respect of improved mass determination for the daughter ions through the improved mass resolution, and also for improved detection through a higher signal-to-noise ratio.

What is claimed is:

1. A method for recording daughter ion spectra in a time-of-flight mass spectrometer, the method comprising:

(a) creating an ion beam containing metastable ions in an ion source by matrix assisted laser desorption, the metastable ions decaying in a time range greater than $10^{-5}$ seconds via a post-source decomposition process;

(b) guiding the ion beam in an original direction from the ion source to a parent ion selector;

(c) reflecting the ion beam with at least one electrical reflector located between the ion source and the parent ion selector;

(d) returning the ion beam to substantially the original direction through the use of further reflectors or deflection capacitors;

(e) selecting ions from the ion beam by means of the parent ion selector;

(f) guiding the selected ions on ion paths from the parent ion selector to a post-acceleration unit; and (g) recording daughter ion spectra for daughter ions that form from the selected ions on the ion paths before the selected ions reach the post-acceleration unit.

2. The method according to claim 1, wherein step (c) comprises reflecting the ion beam with two electrical reflectors, each reflector positioned at an angle to the ion beam.

3. The method according to claim 2, wherein the ion beam additionally passes through at least one deflection capacitor, and wherein the method further comprises positioning the reflectors and the at least one deflection capacitor at angles so that no lateral displacement of the ion beam occurs.

4. The method according to claim 1, wherein step (c) comprises reflecting the ion beam by two anti-parallel reflectors located along the ion beam between the ion source and the parent ion selector, and wherein time-controlled switching of electric fields inside the anti-parallel reflectors allows only ions with a selected mass and a selected energy to reach the parent ion selector.

5. The method according to claim 1, wherein step (c) comprises reflecting the ion beam with one reflector and step (d) comprises deflecting the ion beam with two deflection capacitors, and wherein the reflector and the deflection capacitors are positioned so that no lateral displacement of the ion beam occurs.

6. A time-of-flight mass spectrometer comprising:

an ion source for ionizing a sample by matrix assisted laser desorption, said ion source being capable of creating metastable ions that decay in a time range greater than $10^{-5}$ seconds via a post-source decomposition process;

an acceleration unit in the ion source that creates an ion beam traveling in an original direction;

a parent ion selector for selecting ions in the ion beam;

a post-acceleration unit located downstream of the parent ion selector in the ion path;

a further ion selector located downstream of the post-acceleration unit in the ion path; and at least one electrical reflector located in the ion beam between the acceleration unit and the parent ion selector, the at least one electrical reflector being constructed to allow undecomposed metastable ions to pass therethrough and to filter out ions according to their energy that decompose (a) in the acceleration region of the acceleration unit and have not received the full acceleration energy therein, (b) between the acceleration unit and the at least one electrical reflector and (c) in the at least one electrical reflector.

7. The time-of-flight mass spectrometer according to claim 6, further comprising at least one deflection capacitor arranged in the ion beam at a location and position relative to the reflector so that the ion beam is traveling in the original direction after exiting the reflector.

8. The time-of-flight mass spectrometer according to claim 6, further comprising two electrical reflectors positioned at angles relative to the ion beam, the reflectors located so that the ion beam is traveling in the original direction after passing thorough both reflectors.

9. The time-of-flight mass spectrometer according to claim 8, further comprising two deflection capacitors; the deflection capacitors being positioned relative to the reflectors so that the ion beam is traveling in the original direction without any lateral displacement after passing through both reflectors.

10. The time-of-flight mass spectrometer according to claim 9, further comprising a positioning unit for moving the reflectors and deflection capacitors away from the ion beam.

11. A time-of-flight mass spectrometer, comprising:

an ion source for ionizing a sample by matrix assisted laser desorption, said ion source creating metastable ions that decay in a time range greater than $10^{-5}$ seconds via a post-source decomposition process;

an acceleration unit in the ion source that creates an ion beam traveling in an original direction;

a parent ion selector for selecting ions in the ion beam;

a post-acceleration unit located downstream of the parent ion selector in the ion path;

a further ion selector located downstream of the post-acceleration unit in the ion path; and two anti-parallel electrical reflectors located in the ion beam between the ion source and the parent ion selector; an entrance end and an exit end of each reflector being designed to let the ion beam pass through that reflector substantially unhindered, and an electrical voltage supply for applying voltages to the reflectors in order to form electric fields inside the reflectors, the electrical voltage supply being switched such that the two anti-parallel electrical reflectors allow undecomposed metastable ions to pass therethrough and filter out ions according to their energy that decompose (a) in the acceleration region of the acceleration unit and have not received the full acceleration energy therein and (b) between the acceleration unit and the two anti-parallel electrical reflectors.

12. The time-of-flight mass spectrometer according to claim 11, further comprising a positioning unit for moving the reflectors away from the ion beam.

* * * * *